United States Patent [19]

Wise

[11] Patent Number: 4,784,199

[45] Date of Patent: Nov. 15, 1988

[54] WALLET WITH REMOVABLE CLIP

[76] Inventor: Bradley W. Wise, 2661 Calle Abedul, Thousand Oaks, Calif. 91360

[21] Appl. No.: 62,152

[22] Filed: Jun. 12, 1987

[51] Int. Cl.[4] ..... A45C 1/06; A45C 13/18

[52] U.S. Cl. ..... 150/134; 150/137; 224/230; 224/240; 224/252; 224/269

[58] Field of Search ..... 150/131, 132, 134, 137, 150/147-149; 206/5, 39; 383/23; 224/223, 226, 230, 240, 252, 268, 269; 24/3 R, 3 G, 3 J, 3 L

[56] References Cited

U.S. PATENT DOCUMENTS

| | | | |
|---|---|---|---|
| 649,217 | 5/1900 | Scherer | 224/252 |
| 1,555,714 | 9/1925 | Kahn | 150/134 X |
| 1,618,698 | 2/1927 | Colon | 24/3 R |
| 2,320,067 | 5/1943 | Caughren | 224/268 X |
| 2,595,843 | 5/1952 | Grabhorn | 150/137 |
| 3,854,639 | 12/1974 | Genchi | 224/252 X |
| 4,060,876 | 12/1977 | De Soto | 24/3 J |
| 4,226,006 | 10/1980 | Toyama | 24/3 L |
| 4,475,676 | 10/1984 | Smith | 224/269 X |
| 4,626,454 | 12/1986 | Willie | 150/137 X |

OTHER PUBLICATIONS

Wunder Wallet Flyer (date unknown), Wunder Wallet of California.

*Primary Examiner*—William Price
*Assistant Examiner*—Sue A. Weaver
*Attorney, Agent, or Firm*—Koppel & Jacobs

[57] ABSTRACT

A wallet is provided with a removable clip which permits the wallet to be clipped onto the wearer's waistband. With the clip removed, the wallet can conveniently be placed in the wearer's pocket like a clipless wallet. The clip is coupled to the wallet without the use of barbs or glue. It consists of a three-legged spring clip structure in which the first leg is inserted into the bottom of an exterior pocket on the wallet, the second leg is spring biased against the first leg to hold the clip onto the wallet, and the third leg is spring biased against the second leg to hold the wallet onto the wearer's waistband. The third leg is made wider than the first two legs to reduce the twisting of the clip within the wallet pocket.

8 Claims, 4 Drawing Sheets

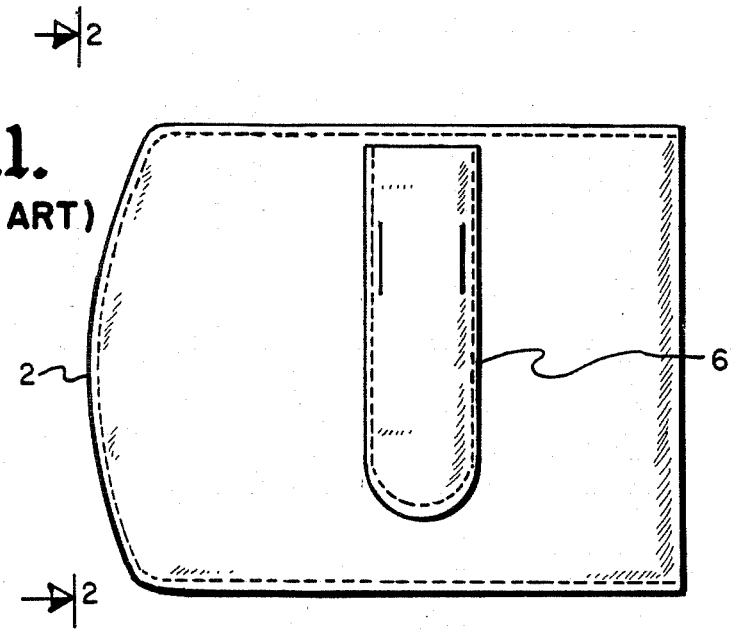
Fig.1.
(PRIOR ART)
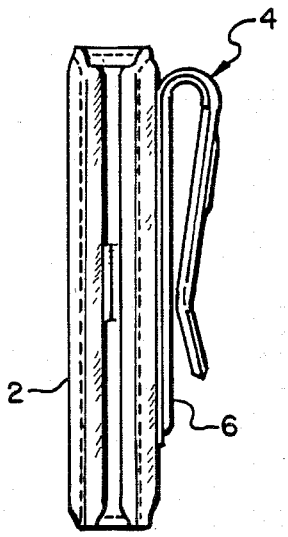
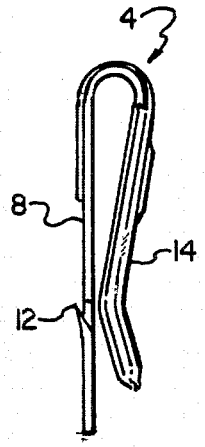
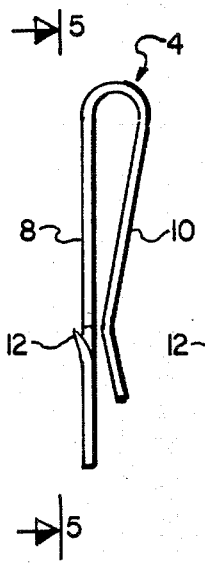
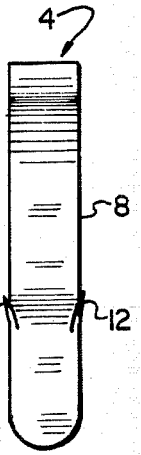
Fig.2. Fig.3. Fig.4. Fig.5.
(PRIOR ART)

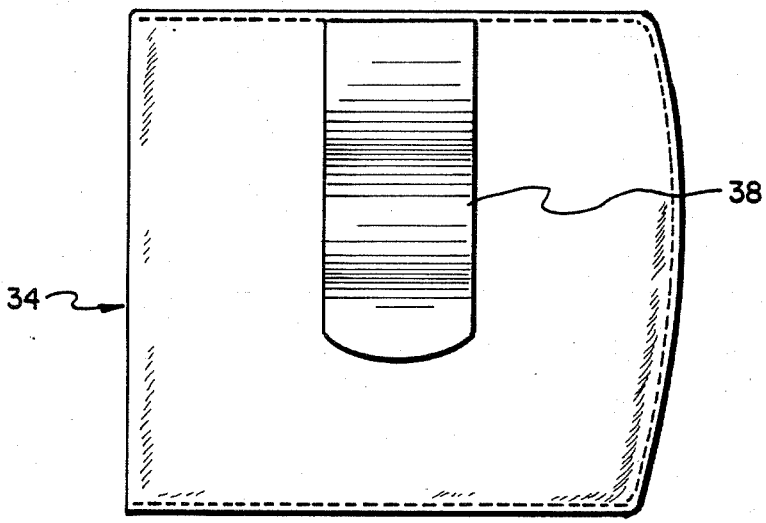
Fig.11.
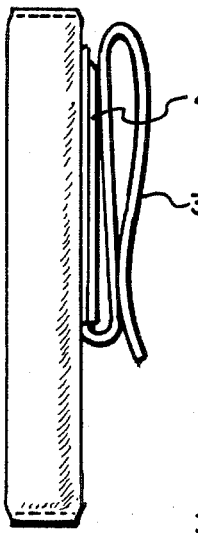
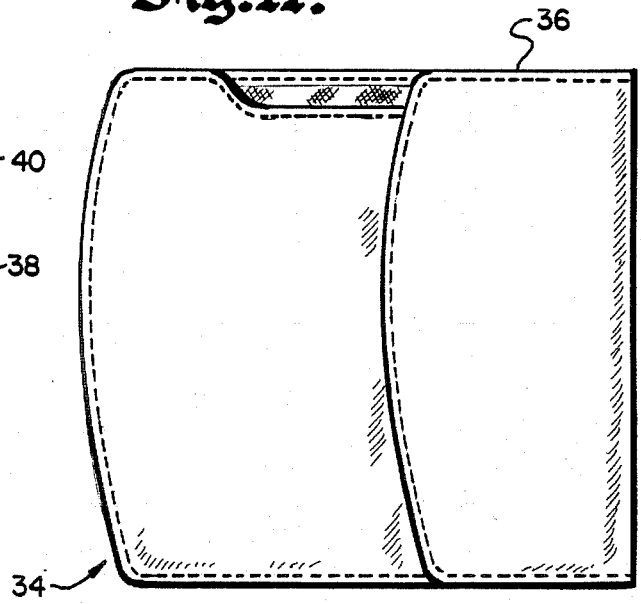
Fig.12.
Fig.13.

WALLET WITH REMOVABLE CLIP

RELATED DISCLOSURE DOCUMENT

This invention is the subject of Disclosure Document No. 164391 filed Feb. 13, 1987 under the Disclosure Document Program of the U.S. Patent and Trademark Office.

BACKGROUND OF THE INVENTION

Field of the Invention

This invention relates to wallets that can be carried in the pocket or worn on the person, and more particularly to a wallet with a clip that attaches to a garment.

Description of the Prior Art

A conventional clip-on wallet is shown in FIGS. 1–5. The wallet consists of a billfold 2 with a clip 4 permanently mounted in a narrow pocket 6 on the side of the billfold. The wallet is shown folded in FIGS. 1 and 2, and opens from the top to insert or remove bills. The clip 4 consists of a narrow strip of metal, typically on the order of ⅜" wide, which is bent approximately 180° into two legs 8 and 10. The inner leg 8 is stamped to form a pair of upward pointing barbs 12 along its edges, and is inserted into the pocket 6 through the open upper end of the pocket. The barbs 12 catch on the wallet material inside the pocket to hold the clip in place. A quantity of glue is also typically added on the wallet side of clip leg 8 to provide additional holding strength for retaining the clip within the pocket.

The bottom of the clip is open between its two legs, permitting the wallet to be clipped on over a wearer's waistband. A fabric sleeve 14 is typically provided over the outer clip leg 10 to present a uniform appearance matching the wallet. With the spring clip slipped on over the wearer's waistband, the barbs 12 and glue are necessary to hold the clip leg 8 within the pocket 6 and prevent the wallet from slipping off the clip.

One of the problems with this type of wallet design is that it limits the use of the wallet to a clip-on device. If the wearer wants to keep the wallet in his or her pocket, particularly the back pocket, the clip creates a bulkiness and hardness that makes the wallet uncomfortable and difficult to insert or remove from the pocket, and also presents an unsightly bulk within the pocket. Another disadvantage is that the clip is subject to considerable lateral twisting as the wallet is attached to or removed from the waistband. This lateral twisting causes wear on the pocket in which the clip is placed, can shorten the useful life of the wallet, and creates a loosening of the clip which eventually comes off.

SUMMARY OF THE INVENTION

In view of the foregoing problems associated with the prior art, an object of the present invention is to provide a novel and improved wallet with a removable clip that allows the wallet to be worn either attached to a waistband with the clip, or in a pocket without the clip.

Another object is the provision of such a wallet with a clip that is retained on the wallet with the assistance of the action of gravity while being worn, but which can still be removed with relative ease when desired.

Still another object is to provide a wallet with a removable clip that can be used as a money clip when it has been removed from the wallet.

A further object is to provide a removable wallet clip which can be inserted into a narrow pocket in the wallet, and yet is subject to little lateral twisting when in place and thus causes less wear on the wallet.

In the accomplishment of these and other objects of the invention, a wallet is provided with an external pocket which is open at the bottom to receive a removable spring clip. The clip can be attached to the waistband or belt or other part of the wearer's clothing.

The clip is preferably formed from a strip of stiffly resilient material which is bent at two 180° bends into first, second and third legs. The first leg is inserted into the wallet pocket from the bottom, with the second leg spring biased against the first leg to hold the clip into the wallet. The third leg is spring biased against the second leg for clipping the device onto the wearer's waistband. With this compound spring clip structure the wallet can be securely attached to the wearer's waistband without danger of the clip slipping out of the wallet, and yet the clip can be easily removed to allow the wearer to place the wallet in his or her pants pocket. When removed from the wallet, the clip may also serve as a money clip.

A special clip design also reduces the tendency of the clip to twist laterally within the wallet pocket. The first and second clip legs are relatively narrow in conformity with the narrow wallet pocket, while the third and outermost clip leg is wider. The contact between the lateral edges of the third leg and the wallet reduces the tendency of the clip to roll or twist within the wallet pocket.

These and other features and advantages of the invention will be apparent to those skilled in the art from the following detailed description of preferred embodiments, taken with the accompanying drawings, in which:

DESCRIPTION OF THE DRAWINGS

FIG. 1 is a front elevation view of a prior art wallet and clip.

FIG. 2 is a side elevation of the prior art wallet and clip of FIG. 1.

FIG. 3 is a side elevation view of a prior art wallet clip within a fabric sleeve.

FIGS. 4 and 5 are respectively side and rear elevation views of the prior art wallet clip of FIG. 3 with the sleeve removed.

FIGS. 11, 12 and 13 are respectively front, side and rear elevation views of another embodiment of the invention.

DETAILED DESCRIPTION OF PREFERRED EMBODIMENTS

One embodiment of a clip-on wallet constructed in accordance with the invention is shown in FIGS. 6–10. The wallet consists of the same general type of billfold 16 as the prior art billfold shown in FIGS. 1 and 2.

However, the clip 18 and the manner in which it is attached to the billfold are distinctly different.

Figures 7, 8, 9, 10:
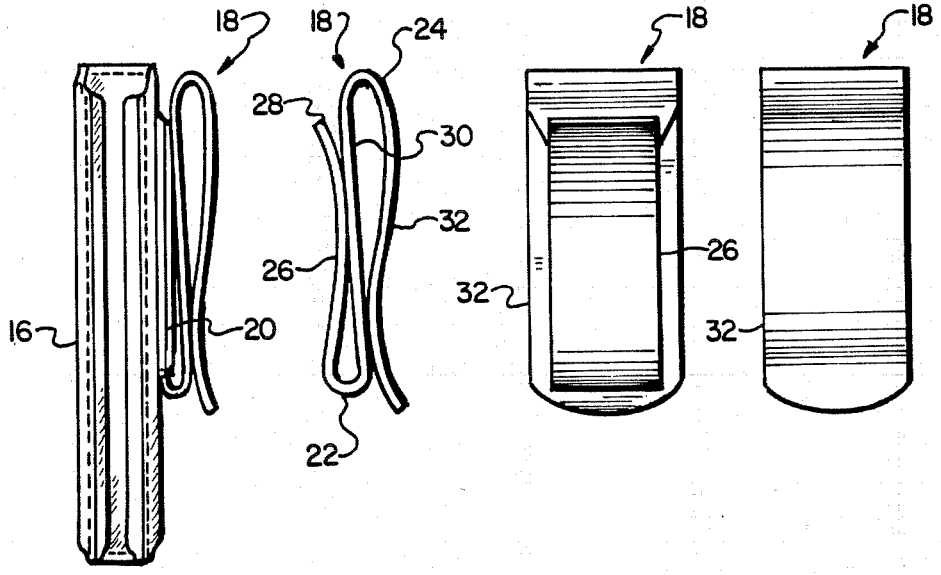
FIG. 7 is a side elevation view of the wallet of FIG. 6.
FIGS. 8, 9 and 10 are respectively side, rear and front elevation views of a removable clip employed in the invention.

The billfold 16 includes a relatively narrow exterior pocket 20 on one side which is open at the bottom. The pocket can either be stitched onto the billfold or held in place by an adhesive. The clip 18 is formed from a strip of stiffly flexible, resilient material, preferably spring steel having a thickness in the approximate range of 0.10 to 0.15 cm. As best shown in FIG. 8, it is bent at two approximately 180° bends 22 and 24 into three distinct legs. The first leg 26, which is shown oriented as it would be inserted into the billfold which opens at the top to receive bills, extends downward from end 28 of the strip to the first 180° bend 22. The second leg 30 extends upward generally adjacent to the first leg 26 from the first 180° bend 22 to the second 180° bend 24. The third leg 32 extends downward from the second 180° bend 24, and preferably terminates beyond the first bend 22.

The clip thus assumes the general shape of a flattened "S". The first leg 26, as shown in FIG. 8, is spring biased against the second leg 30 in the vicinity of the second bend 24, while the third leg 32 is spring biased against the second leg 30 in the vicinity of the first bend 22. The first leg 26 is inserted into the exterior wallet pocket 20 from the bottom, as shown in FIG. 7. The force of gravity thus urges the wallet down further onto leg 26. The top of the pocket is preferably closed and bottoms against the upper end 28 of clip leg 26 to hold the wallet in place. Even if the pocket were open at the top, it would be prevented by the first clip bend 22 from falling down off the clip. The spring bias which causes the first and second clip legs 26 and 30 to bear against each other holds the clip onto the wallet when it is not being worn.

The clip 18 can be a standard eye glass case spring clip. Preferably, however, the clip can be specially designed as shown in the accompanying drawings to reduce its tendency to twist within the wallet pocket 20. In the preferred clip design shown in FIGS. 8–10, the first and second legs 26 and 30 are about ½" wide, so that the first leg fits snugly into pocket 20. The outermost leg 32 is considerably wider, preferably about 1½ times as wide or ¾". When in place on the wallet as seen in FIG. 6, the lateral edges of outermost leg 32 extend beyond the narrower inner legs and bear against the surface of the wallet to help prevent the clip from twisting.

Figure 6:
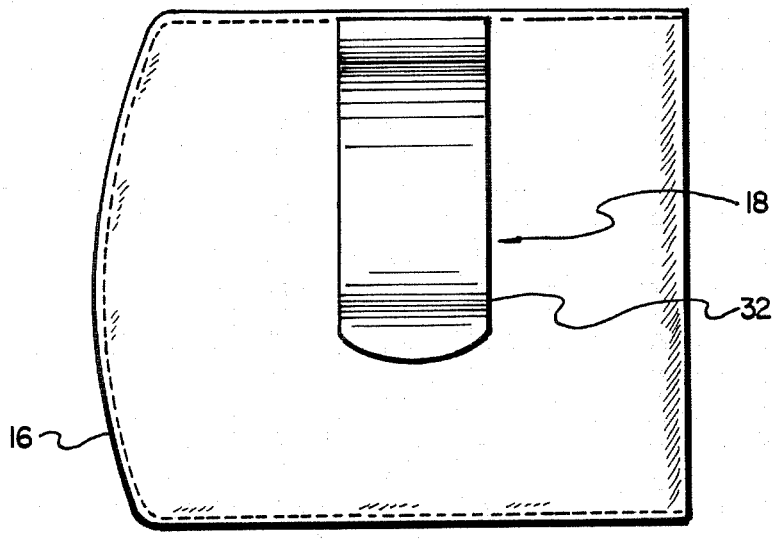
FIG. 6 is a front elevation view of a clip-on wallet constructed in accordance with the invention.

The clip can either be affixed to the wallet as shown in FIGS. 6 and 7, or removed simply by slipping the clip downward to dislodge leg 26 from the wallet pocket 20. With the clip removed, the wallet can easily be placed in the wearer's pants pocket just as any non-clip wallet. The clip itself can then be used as a separate money clip.

Another embodiment of the invention, referred to as the "sport model", is illustrated in FIGS. 11–13. In this embodiment the wallet 34 is not folded over, but rather opens along the top and right hand side. A flap 36 extends from the rear of the wallet over the right side and snaps onto the front (snap not shown) to close the wallet. The removable spring clip 38 is a similar construction to that employed in the previous embodiment, and again is inserted into the bottom of a pocket 40 on the exterior of the wallet. The clip can be finished in a variety of decorative colors to match the color of the wallet, or to provide a contrast therewith.

Figures 14, 15, 16:
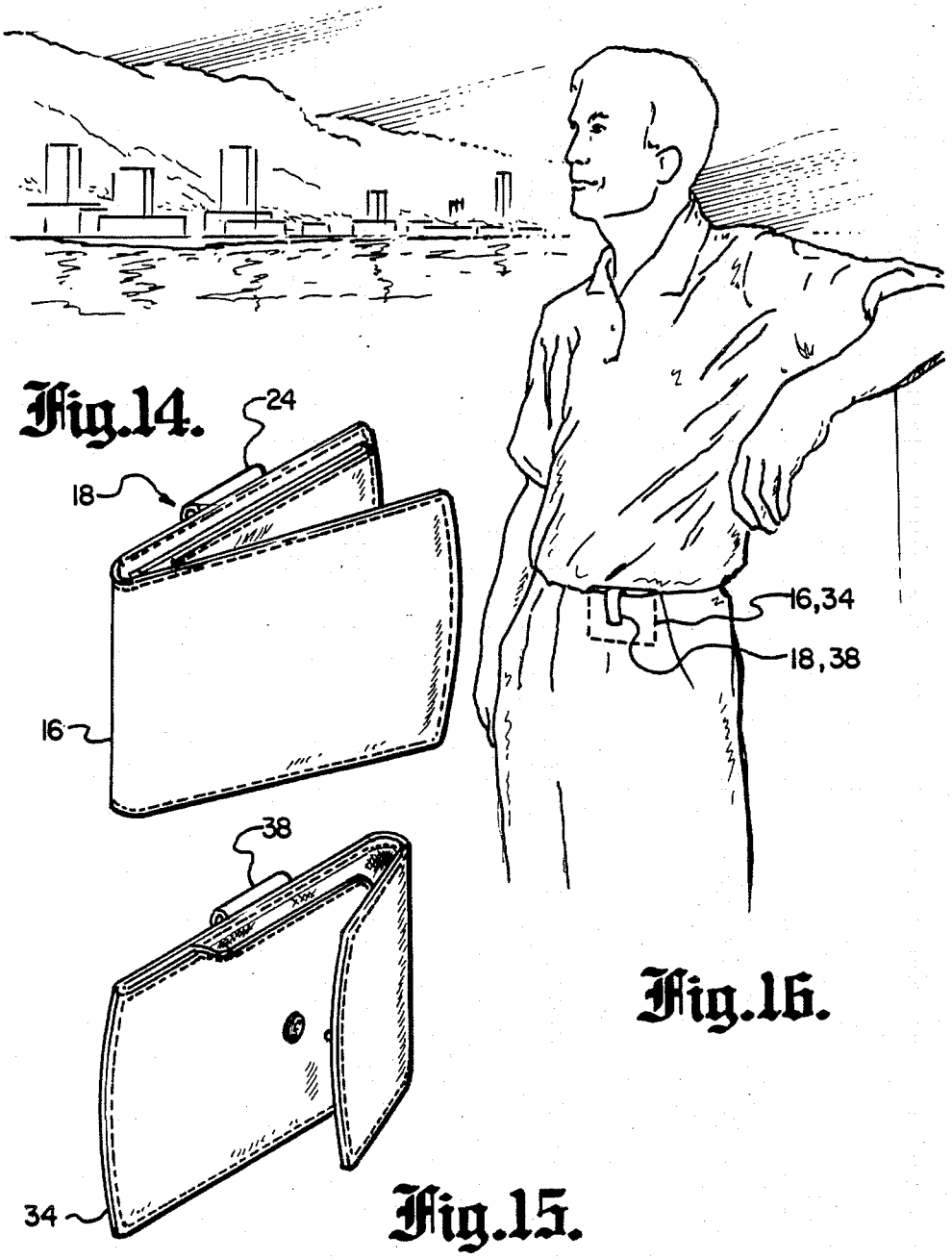
FIGS. 14 and 15 are perspective views of the embodiments of FIGS. 6 and 11, respectively.
FIG. 16 is a perspective view of a wallet constructed in accordance with the invention clipped onto the wearer's waistband.

The first and second wallet embodiments are shown partially opened in FIGS. 14 and 15, respectively. In FIG. 14 the billfold 16 is shown as opening at the top, with the clip's second 180° bend 24 near the top edge of the wallet. In FIG. 15 the "sports model" is open at both the top and side, and again the clip extends to near the top edge of the wallet.

The position in which either wallet 16 or 34 is preferably worn is shown in FIG. 16. The wallet is clipped onto the wearer's waistband, with the wallet inside the waistband and the outermost leg of the clip 18 or 38 on the outside of the waistband. In this position the wallet is secured against accidental loss or theft, and yet is easily accessible.

Different embodiments of an improved clip-on wallet have thus been shown and described. As numerous variations and alternate embodiments will occur to those skilled in the art, it is intended that the invention be limited only in terms of the appended claims.

I claim:

1. A clip-on wallet, comprising:

a wallet opening from the top and having a pocket on the exterior thereof which is open on the bottom, and a spring clip which is removably lodged in said pocket, the clip when in the pocket providing a means for attaching the wallet to a garment, and when removed from the pocket enabling the wallet to be carried without obstruction by the clip, said clip including a first arm that fits within said pocket, a second arm attached to and spring biased against the first arm from outside the pocket to hold the first arm within the pocket, and a third arm attached to and spring biased against the second arm to grasp a garment between the second and third arms, said first arm fitting snugly into said pocket, and said third arm being substantially greater in width than said first arm and bearing against the wallet lateral to said pocket to limit twisting of the clip with respect to the wallet.

2. The clip-on wallet of claim 1, wherein said third clip arm extends downward from the top of the second clip arm and adjacent thereto.

3. The clip-on wallet of claim 1, wherein the widths of said first and second clip arms are similar and both are narrower than said third clip arm.

4. The clip-on wallet of claim 3, wherein the width of said third clip arm is approximately 1½ times the widths of the first and second clip arms.

5. The clip-on wallet of claim 1, wherein said clip comprises a strip of stiffly resilient material having first and second substantially 180° bends and formed into a flattened "S" shape, said first arm joining the second arm at the first bend and said second arm joining the third arm at the second bend.

6. The clip-on wallet of claim 5, wherein the end of the first arm opposite the first bend is spring biased against the second arm in the vicinity of the second bend, and the end of the third arm opposite the second bend is spring biased against the second arm in the vicinity of the first bend.

7. The clip-on wallet of claim 6, wherein the first arm terminates short of the second bend, and the third arm extends beyond the first bend.

8. The clip-on wallet of claim 5, wherein said clip is formed from spring steel having a thickness in the approximate range of 0.10 to 0.15 cm.

* * * * *